US008727670B2

(12) United States Patent
Roelofs

(10) Patent No.: US 8,727,670 B2
(45) Date of Patent: May 20, 2014

(54) TUNNEL BARRIER

(75) Inventor: Heinrich Jan Roelofs, Como (AU)

(73) Assignee: Tagfilm Pty Limited, Como, Western Australia (AU)

( * ) Notice: Subject to any disclaimer, the term of this patent is extended or adjusted under 35 U.S.C. 154(b) by 1353 days.

(21) Appl. No.: 11/994,070

(22) PCT Filed: Oct. 7, 2005

(86) PCT No.: PCT/AU2005/001546

§ 371 (c)(1),
(2), (4) Date: Mar. 19, 2008

(87) PCT Pub. No.: WO2006/135951

PCT Pub. Date: Dec. 28, 2006

(65) Prior Publication Data

US 2008/0190032 A1 Aug. 14, 2008

(30) Foreign Application Priority Data

Jun. 21, 2005 (AU) ..... 2005903250

(51) Int. Cl.
*E21F 17/107* (2006.01)

(52) U.S. Cl.
USPC ..... 405/289; 405/272

(58) Field of Classification Search
USPC ..... 405/132, 135, 141, 142, 143, 144, 146, 405/147, 152, 288, 289; 454/169
See application file for complete search history.

(56) References Cited

U.S. PATENT DOCUMENTS

| | | | | |
|---|---|---|---|---|
| 2,328,083 | A * | 8/1943 | Lineback | 5/709 |
| 3,937,025 | A * | 2/1976 | Alvarez-Calderon | 405/267 |
| 4,023,372 | A | 5/1977 | Presler et al. | |
| 4,036,024 | A | 7/1977 | Dreker et al. | |
| 4,072,015 | A * | 2/1978 | Morrell et al. | 405/289 |
| 5,376,705 | A * | 12/1994 | Leys et al. | 523/417 |
| 5,469,920 | A | 11/1995 | Conti et al. | |
| 6,779,601 | B2 * | 8/2004 | Wilson et al. | 166/187 |

FOREIGN PATENT DOCUMENTS

| | | |
|---|---|---|
| DE | 23 28 261 | 7/1975 |
| FR | 2 290 228 | 6/1976 |
| WO | 91/06746 | 5/1991 |
| WO | 98/46859 | 10/1998 |
| WO | 00/19063 | 4/2000 |

* cited by examiner

*Primary Examiner* — Benjamin Fiorello
(74) *Attorney, Agent, or Firm* — Gottlieb, Rackman & Reisman, P.C.

(57) ABSTRACT

A tunnel barrier (11) adapted to seal a mine tunnel, the tunnel barrier (11) comprising an inflatable bladder having a front wall (14), a rear wall (15) and a side wall (16) and being adapted to be inflated by a suitable gas, wherein the side wall is adapted to contact the tunnel walls, including the roof and floor to thereby seal the tunnel.

26 Claims, 8 Drawing Sheets

TUNNEL BARRIER

FIELD OF THE INVENTION

The present invention relates to a barrier suitable for use in a mine tunnel. It has several applications, one of which concerns the blocking of a mine tunnel to restrict airflow and another concerns the filling of a stope void after mining of a stope block has been completed.

BACKGROUND ART

Throughout the specification the term "tunnel" shall be taken as including any form of underground passage either natural or man-made with a significant horizontal component which shall be taken as including tunnels, inclines, declines and the like. Also, throughout the specification, unless the context requires otherwise, the word "comprise" or variations such as "comprises" or "comprising", will be understood to imply the inclusion of a stated integer or group of integers but not the exclusion of any other integer or group of integers.

There are many occasions in underground mining where it is necessary to seal off a mine tunnel in a temporary basis. One reason for doing this is to provide ventilation control, for example where tunnel routes are changed when a new body of ore is opened. In such applications, it is usual to block the tunnel by building a wall from concrete. When the need for blocking the tunnel has passed, it is then necessary to demolish the wall. Both processes are relatively expensive and time consuming to undertake. Another reason for blocking a tunnel is to control emergency situations, for instance a fire in the mine where it is necessary to quickly prevent the distribution of smoke. In such situations it is often necessary block the tunnel very quickly to be effective.

A further need for temporary blocking of a tunnel concerns the filling of a stope void. Underground mining processes are often undertaken by removal of a segment of ore body known as a stope block. A typical stope block might be approximately 100 m in length, 20 m in width and 60 m in height. After mining of one stope block is completed, it is necessary to fill the void created before mining can commence on adjacent ore. In normal operations, the void is filled with one of the following filling means: paste fill, cement aggregate rock fill (CAP) or cement rock fill (CRF). Prior to the filling of a void, it is necessary to seal any tunnels entering the void so that filling material does not travel into and interfere with the tunnel.

Again, the sealing of a tunnel for this purpose has usually been achieved by erecting a barrier concrete wall, which sometimes must be demolished immediately after the void is filled. Of course, a concrete wall is not re-usable, as, once erected, it cannot be moved to another location.

DISCLOSURE OF THE INVENTION

Accordingly, the invention resides in a tunnel barrier adapted to seal a tunnel, the tunnel barrier comprising an inflatable bladder having a front wall, a rear wall and a side wall and being adapted to be inflated by a suitable gas, wherein the side wall is adapted to contact the tunnel walls, including the roof and floor to thereby seal the tunnel, the front and rear walls being interconnected by a restraining means located intermediate of their connection the side wall to limit the relative movement of the front and rear walls away from each other.

According to a preferred feature of the invention the restraining means comprises at least one flexible, substantially inextensible connections extending between the front wall and rear wall. According to a preferred feature of the invention the restraining means comprise at least one elongate cord-like elements. According to a preferred feature of the invention the restraining means comprises a webbing material.

According to a preferred feature of the invention, the base of the tunnel barrier is substantially square.

According to a preferred feature of the invention, the tunnel barrier has a generally cubic shape.

According to a preferred feature of the invention, the cross-section of the tunnel barrier through the side walls when inflated substantially conforms to the cross-section of the tunnel.

According to a preferred feature of the invention in use the tunnel barrier is adapted to seal a tunnel during the partial filling of an adjacent void to prevent fill material from the void entering the tunnel beyond the barrier, whereby, the front wall defines a face of the void.

According to a preferred feature of the invention, the tunnel barrier is re-usable.

According to a preferred feature of the invention, the tunnel barrier is inflatable vie an inflation port in the rear wall.

According to a preferred embodiment, the bladder is manufactured from fibre-reinforced PVC.

According to a preferred embodiment, the bladder is manufactured from TARPOL or similar material.

According to a preferred embodiment, the bladder is manufactured from COMPLAS 300 or similar material.

According to a further aspect, the invention resides in a method of temporarily erecting a barrier in a tunnel to thereby seal the tunnel during the partial filling, of an adjacent void to prevent void fill material from entering the tunnel beyond the barrier, the method comprising the steps of positioning an inflatable tunnel barrier of the type as previously described in a desired location in a tunnel proximate to the void, and inflating the tunnel barrier to cause the side walls of the barrier to contact and thereby seal the tunnel, whereby the front wall is caused to act as a barrier to said fill material.

According to a preferred feature of the invention, the void is filled in a plurally of filling operations wherein in the first filling operation the fill material is added to the void to first level whereafter the fill material is allowed to cure before a subsequent fill operation is undertaken.

According to a preferred feature of the invention, the front wall is covered by a layer to prevent fill material from adhering to the front wall. According to a preferred embodiment, the layer comprises a grease-like or wax-like material covering the front wall. According to a preferred embodiment, the layer comprises a sacrificial lining to prevent cured fill material from adhering to the front wall. According to a preferred embodiment, the sacrificial lining comprises a sheet of fabric or plastics material. According to a preferred embodiment, the front wall is protected by a physical barrier capable of withstanding the impact of fill material.

The invention will be more fully understood in the light of the following description of two specific embodiments.

BRIEF DESCRIPTION OF THE DRAWINGS

The description is made with reference to the accompanying drawings of which.

DETAILED DESCRIPTION OF SPECIFIC EMBODIMENT

The embodiments of the invention are directed to an inflatable tunnel barrier adapted to be installed in a mine tunnel. The tunnel barrier when installed is adapted to seal a tunnel.

Figure 1:
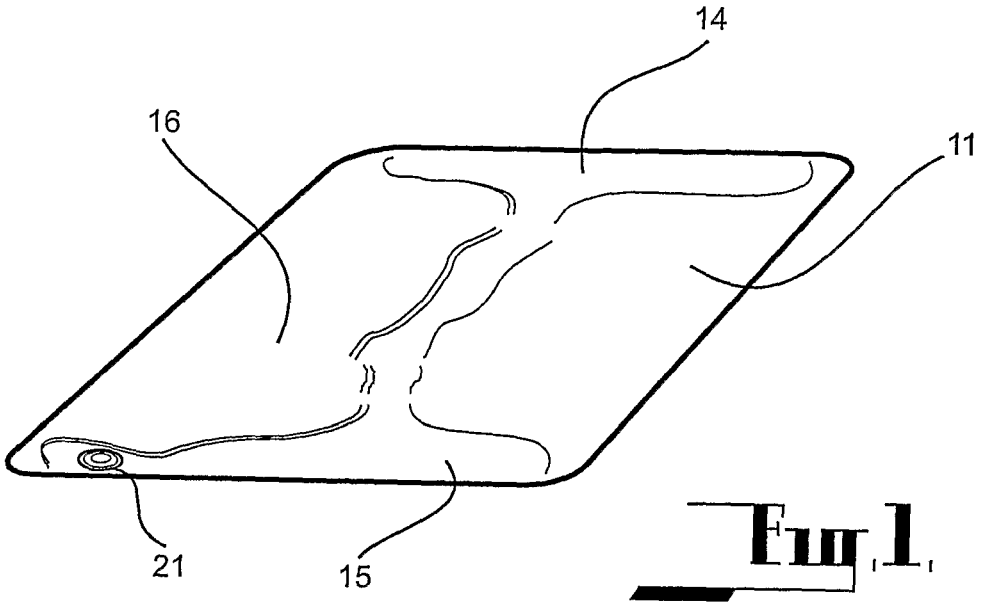
FIG. 1 is an isometric view of a tunnel barrier according to the first embodiment, the tunnel barrier shown in a deflated condition.
Figure 2:
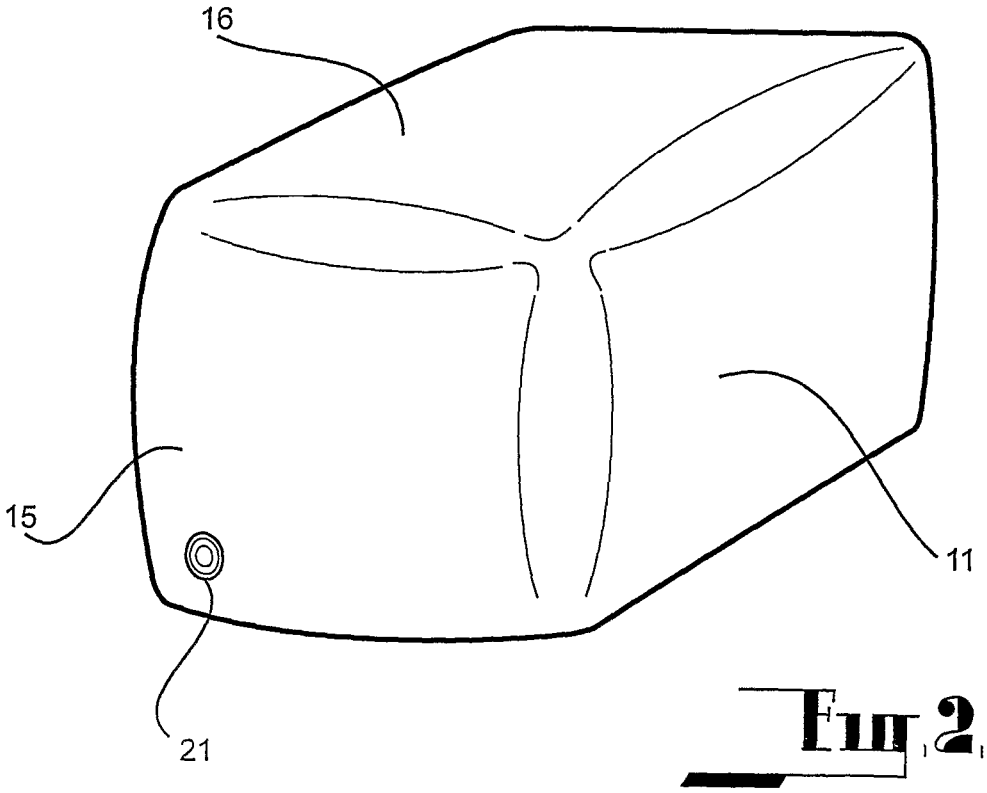
FIG. 2 is an isometric view of a tunnel barrier of FIG. 1, the tunnel barrier shown in an inflated condition.
Figure 3:
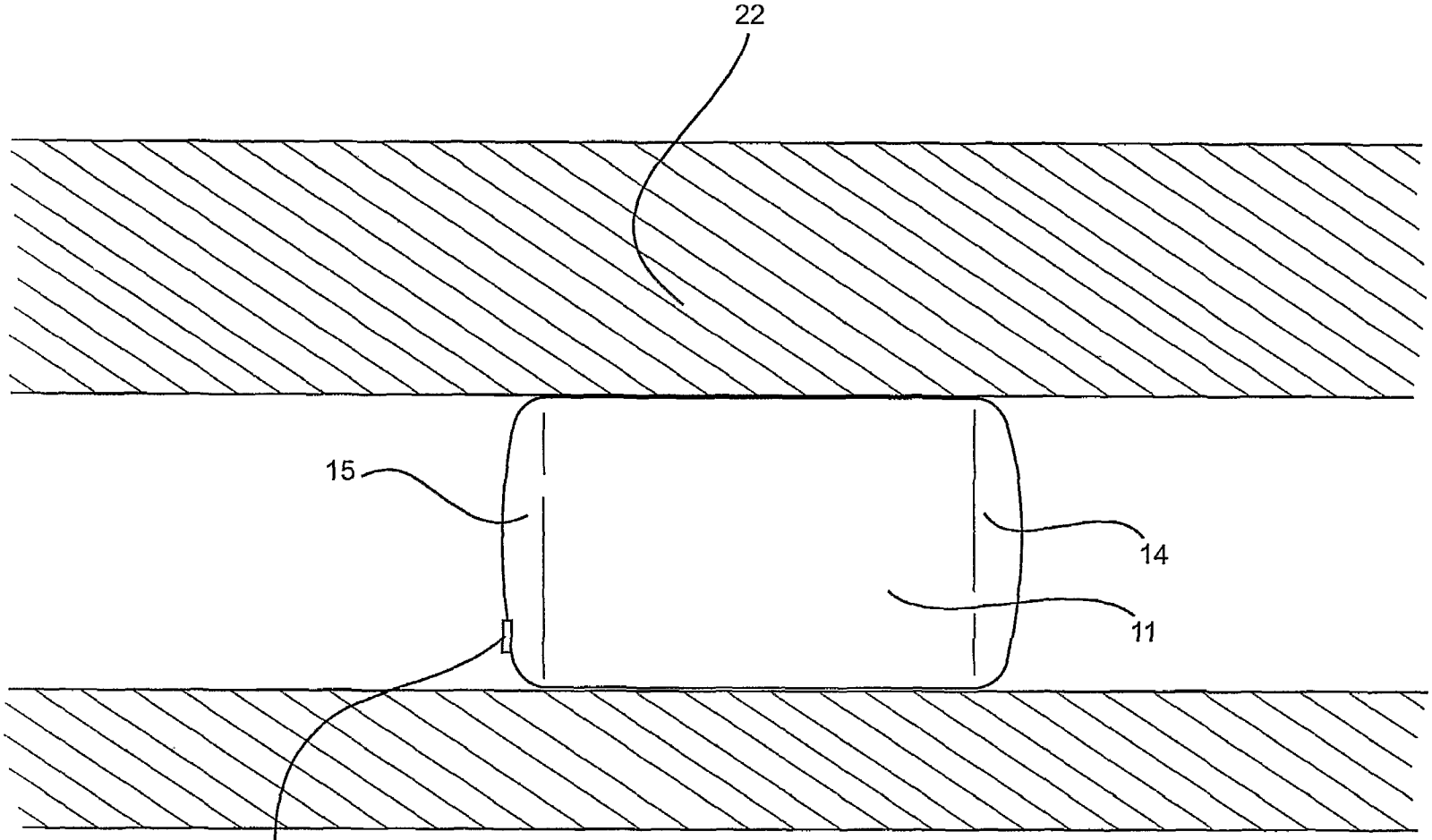
FIG. 3 is a diagrammatic elevation of an inflated tunnel barrier according to FIG. 1; the tunnel barrier being located with a mine tunnel.

The first embodiment is described with reference to FIGS. 1 to 3.

The embodiment is a tunnel barrier 11 which comprises an inflatable bladder having a front wall 14, a rear wall 15 and a side wall 16 of flexible, substantially airtight material. Reinforced PVC sheeting has been found to be particularly, suitable for this application although other materials will also fulfil the function. One material found particularly suitable comprises a Panama woven polyester, 12×12 PVC coated with Acrylic lacquer on both sides. This product is marketed under the trade mark "COMPLAS 300" Fabric. An alternative material is a woven polyester 8×8.5 incorporating tear stop threads in both directions, PVC coated with acrylic lacquer on the top surface. This product is marketed under the trade mark "TARPOL". It will be appreciated that a range of such fabrics are available and alternative similar products may also be used. The material can be selected more particularly for the application according to its properties, particularly to provide suitable strength and weight characteristics.

The tunnel barrier 11, when inflated as described below, expands to fill a portion of the tunnel with the side wall 16 of the tunnel barrier 11 contacting and pressing against the tunnel walls, including the roof and the floor of the tunnel. The cross section of the tunnel barrier through the side wall is configured when inflated to conform substantially with cross section of the tunnel and has a length comparable to the width of the tunnel. A tunnel barrier for a typical mine has a generally cube shape when inflated with the dimensions of the order of 6 m. However, the configuration may be varied where the tunnel profile differs from the typical tunnel mentioned above. Nevertheless, it is necessary that the tunnel barrier must extend along the length of the tunnel sufficiently to ensure adequate sealing and also to provide sufficient stability during inflation. It has been found that attempts to provide a inflatable tunnel barrier of generally spherical shape have been unsuccessful, because of the relatively short length of contact with mine walls and roof. Because of the irregular surface typical of a mine tunnel, it has been found that the tunnel barrier must contact the tunnel walls and roof for a substantial length to provide a seal, as there are portions of the contact area that will not provide sealing. With sufficient length of contact area, the non-contact zones become irrelevant as the required seal is provided by another zone. As well there is another issue which concerns the length of the tunnel barrier. If the tunnel barrier is too short, so that the base is of a rectangular shape with the narrow sides of the rectangle adjacent the tunnel walls, the tunnel barrier may tend to fall either forwardly or rearwardly during inflation, and jam prematurely in an orientation that does not provide proper sealing. This is a particular problem in mines as there is usually a substantial airflow through the mine tunnels for ventilation purposes and the semi-limp character of the tunnel barrier during inflation is very susceptible to being displaced by the moving air during inflation. It has been found that a tunnel barrier with a base of approximately square shape generally provides an optimum configuration.

In certain applications the tunnel barrier 11 may be provided with anchor points. The anchor points are typically loops of fabric material used for the wall of tunnel barrier and secured to the wall by adhesive, stitching, welding or a combination of these methods. Anchoring points may be useful for providing support during inflation especially in the event that a draft is present in the tunnel. They may also be used for applying ropes, lines or the like to the bladder to enable precise positioning of the tunnel barrier prior to and during inflation. However, in many applications it is found that anchor points would not be necessary.

Figure 8:
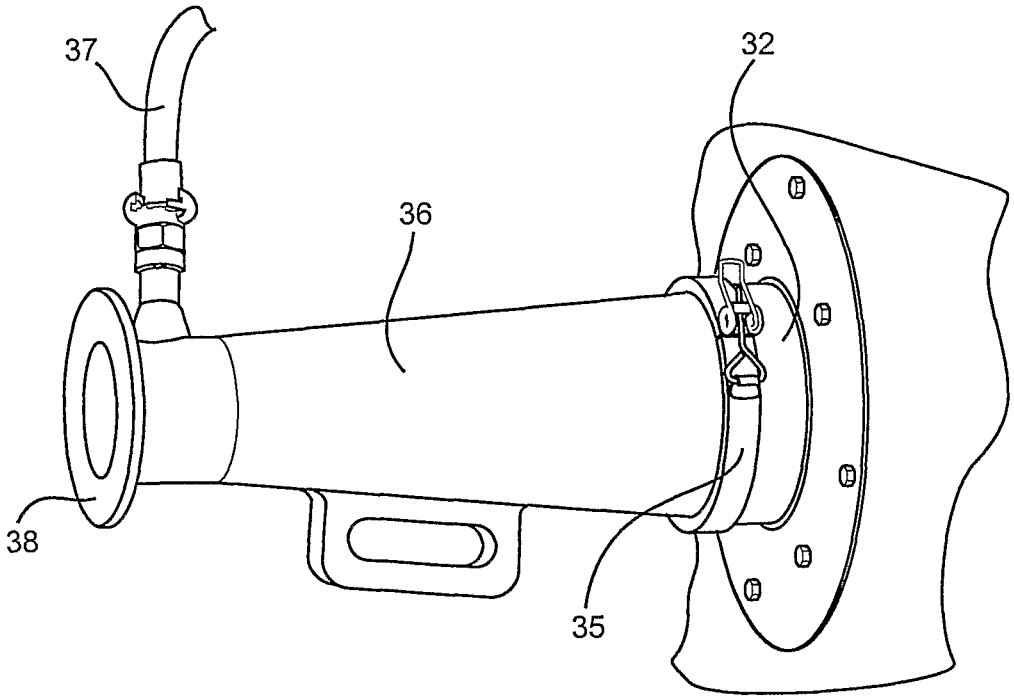
FIG. 8 is an isometric view of the inflation port of the embodiments showing a venturi air amplifier attached for inflation of the tunnel barrier.
Figure 9:
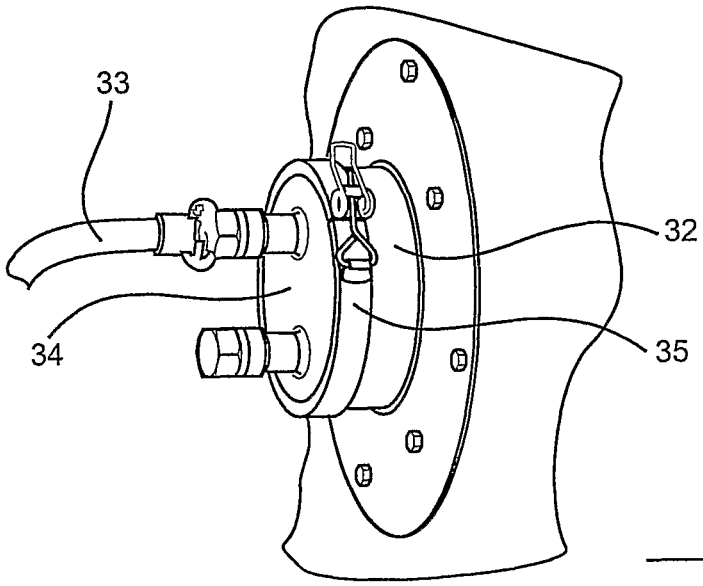
FIG. 9 is an isometric view of the inflation port of the embodiments showing the standard air supply attached to maintain inflation of the tunnel barrier.
Figure 10:
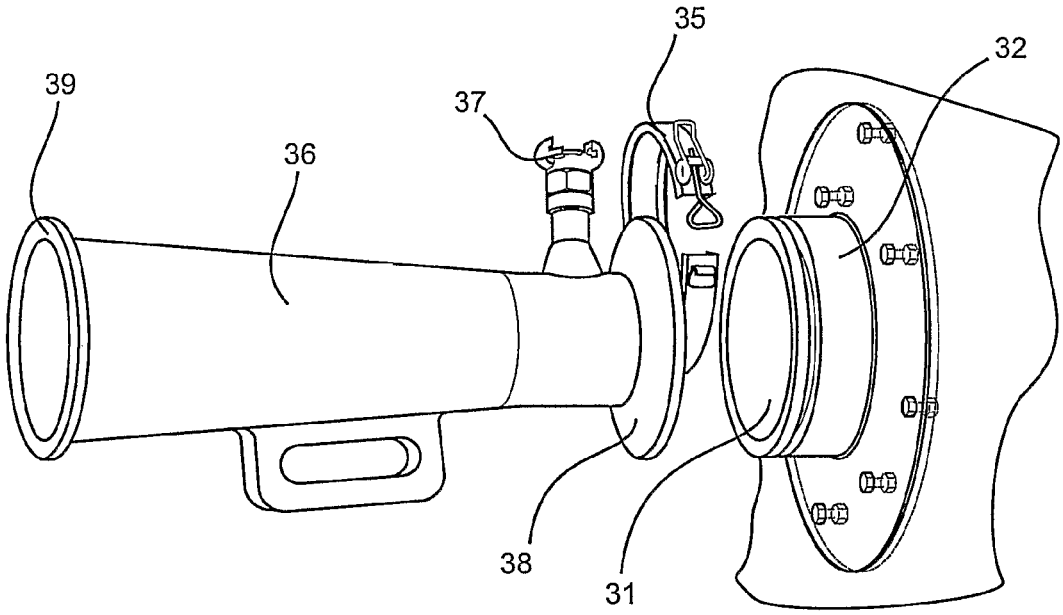
FIG. 10 is an isometric view of the inflation port of the embodiments showing a venturi air amplifier in detached positioned, prior to attachment for deflation.
Figure 11:
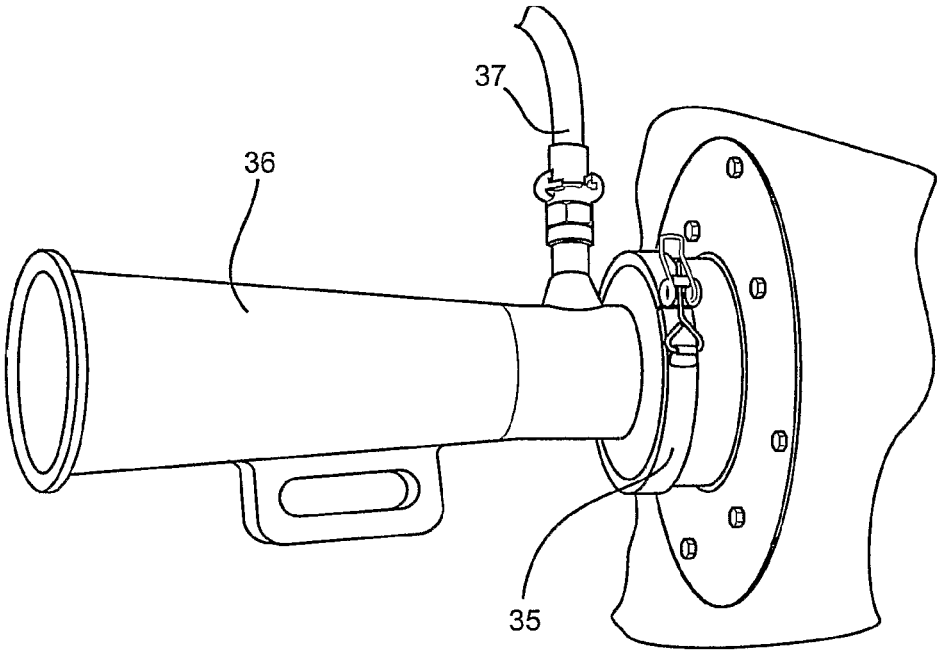
FIG. 11 is an isometric drawing of the inflation port of the embodiments showing a venturi air amplifier attached for deflation of the tunnel barrier.

The rear wall 15 is provided with an inflation port 21 by which a suitable inflating gas, usually air, can be inserted into the bladder for inflating the tunnel barrier 11 or released from the bladder to deflate the tunnel barrier 11. While many conventional styles of inflation ports are possible, the embodiment advantageously utilizes a port 21 comprising an aperture 31 within the bladder wall surrounded by flanged rim 32. The inflation means is shown in more detail in FIGS. 8 to 11. The aperture 31 has a typical size of about 20 cm diameter. As shown in FIG. 9, an air source 33 is adapted to be connected to the flanged rim by the clamping of a cooperating outlet 34 of the air source to the flanged rim 31 by means of a suitable bracket 35. Two types of air supplies are made available. The first, as shown in FIG. 9, comprises a conventional regulated supply 33 fed from the distributed air supply within the mine. This supply is used to replace any minor air leakage that may occur as a result of punctures or the like. It provides an air supply regulated to the required pressure but capable of only a modest flow rate. The second air supply makes use of a venturi air amplifier 36 for rapid inflation of the bladder during installation, as shown in FIG. 8, or by reversing the assembly, or deflation, upon removal, as shown in FIGS. 10 and 11. Venturi air amplifiers are available which are connectable to the standard pressurised air supply (approx 100 psi.) 37 which amplify the air flow by a factor in the order of 30:1. Such a device is very suitable for the present application as air at only a low pressure is required to inflate the tunnel barrier, but the quantity of air required to be pumped into the bladder is substantial. The venturi air amplifier supplies air in this way. Its use is particularly important where the tunnel barrier is used for an emergency purpose where rapid inflation from a portable air supply such as a small compressor or bottle of compressed gas may be used, where time of inflation may be a vital safety factor, for example, when trying to restrict the spread of smoke in a tunnel and when the air supply mains may not be available. Thus the tunnel barrier is initially inflated by the venturi supply then the regulated supply is connected and the pressure maintained.

The venturi air amplifier is adapted to have an inlet flange 38 at both the inlet end and the outlet end In some adaptations of the embodiment, an inflation port is provided in both the front and rear wall.

Once installed, an air supply is maintained to the tunnel barrier while it is erected. This supply is only required to supply leakage from the bladder which is normally virtually non-existent. However the supply ensures that the tunnel barrier will remain inflated even if punctured inadvertently. As mentioned above, in use, the tunnel barrier requires inflation to only a very low pressure in the vicinity of 4 to 20 kpa (0.5 to 2.5 psi) the pressure may depend upon the material being used. This pressure is too low for the tunnel barrier to be regarded as a pressure vessel, and thus it is not necessary to address the safety issues that inure to such devices.

This low pressure does cause the front wall and rear wall to bow out, somewhat, typically in the order of 0.5 to 1 meter for a 6 meter cube. This bowing out is not a matter of concern for the device for normal sealing uses.

The tunnel barrier of the embodiment has several advantages. It is light in weight (typically less than 200 kg) and can be stored in its deflated form as a compact package. It is therefore easy to transport to the location required for use. This is especially important in an emergency. It is easy too erect by inflation from normally available air supplies and can be deflated and stored for reuse when its use has finished. Its cost is relatively low and installation costs are very low. The use of the venturi port enables very rapid inflation. Once inflated, the large area of contact, even though only at very low pressure ensures that the tunnel barrier is held in place very securely and provides a positive seal to the tunnel.

The second embodiment is directed to a tunnel barrier adapted to seal a tunnel during the partial filling of an adjacent void to prevent void fill material from entering the tunnel beyond the barrier. The embodiment is described with reference to FIGS. 4 to 7. The second embodiment is similar to the first embodiment and so in the drawings like numerals are used to depict like parts.

The second embodiment is constructed from similar material to that of the first embodiment.

Figure 4:
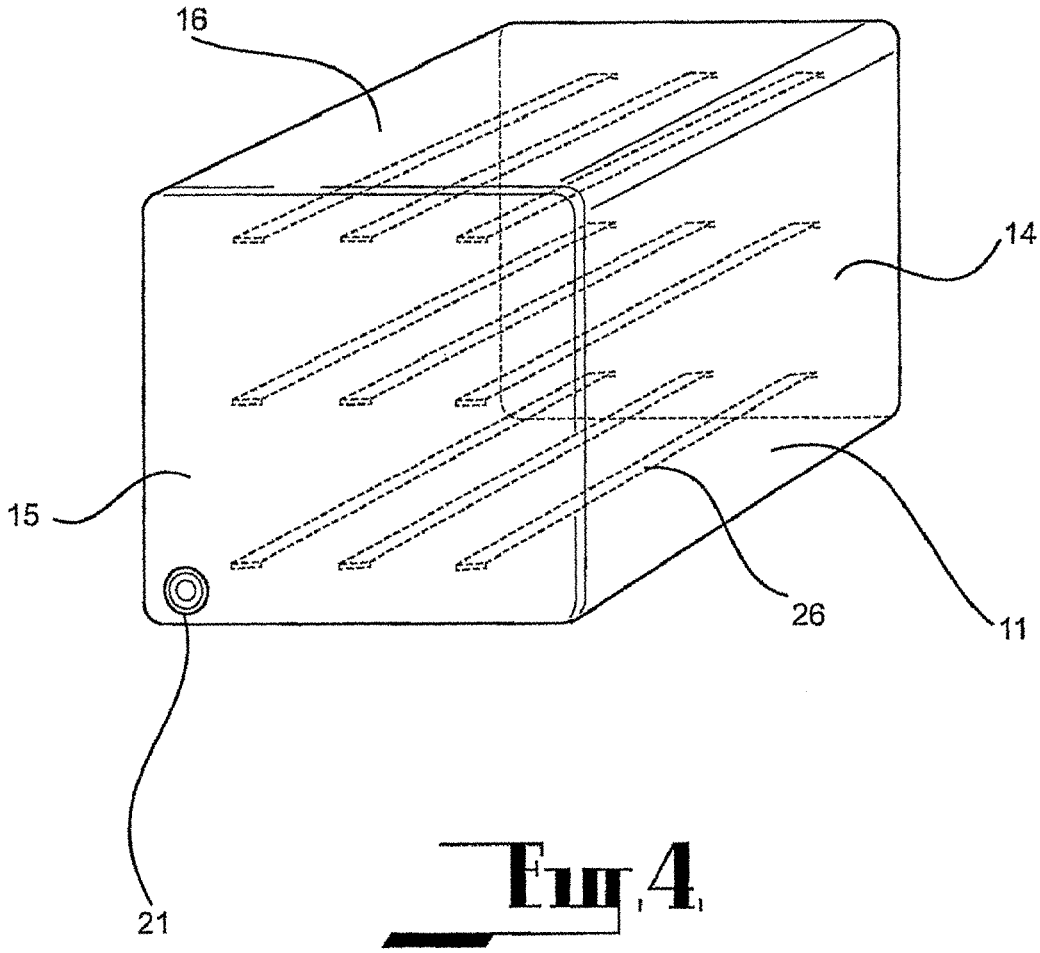
FIG. 4 is an isometric view of a tunnel barrier according to the second embodiment, the tunnel barrier shown in an inflated condition.
Figure 5:
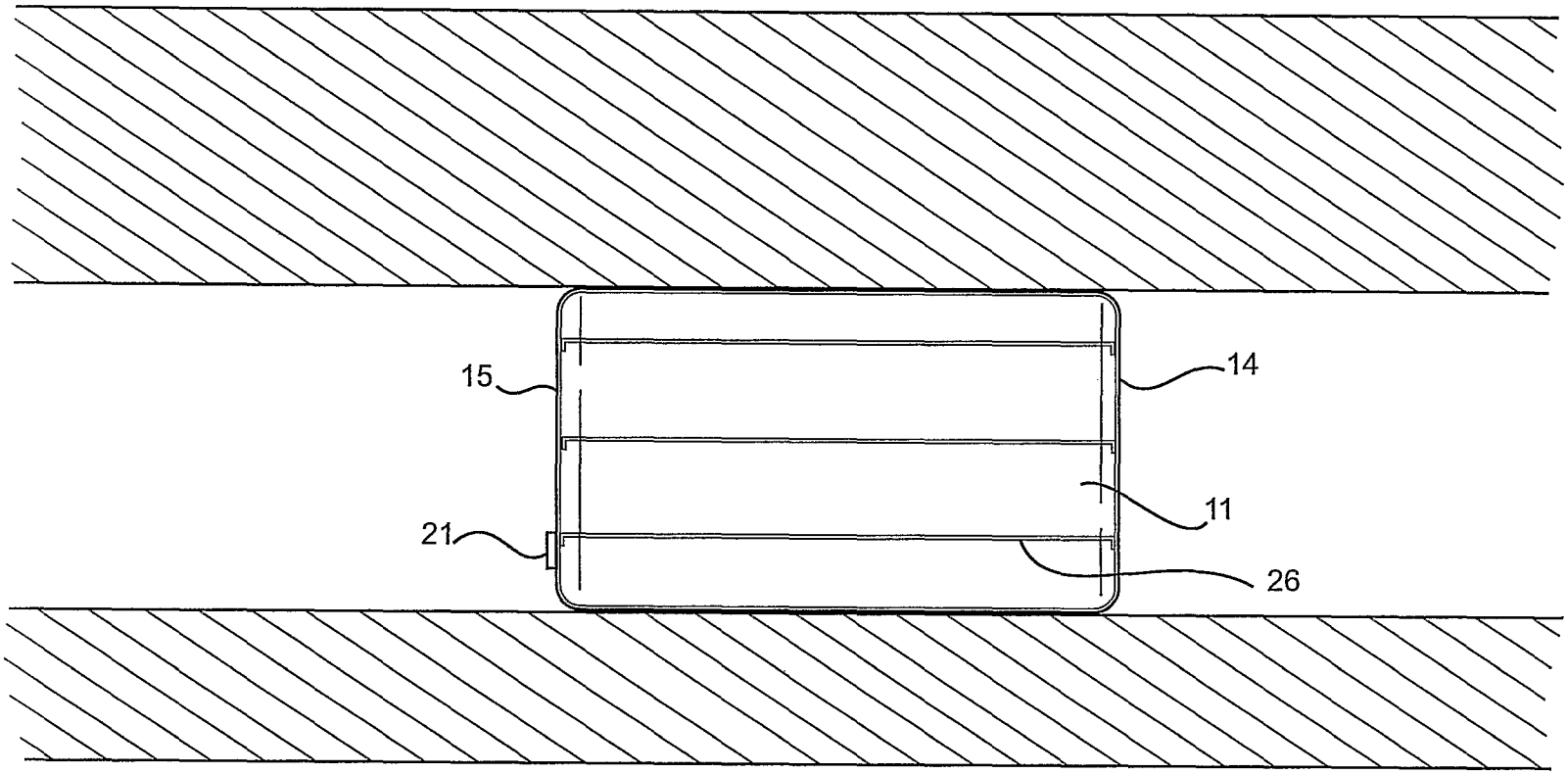
FIG. 5 is a diagrammatic elevation of an inflated tunnel barrier according to FIG. 4; the tunnel barrier being located with a mine tunnel.
Figure 6:
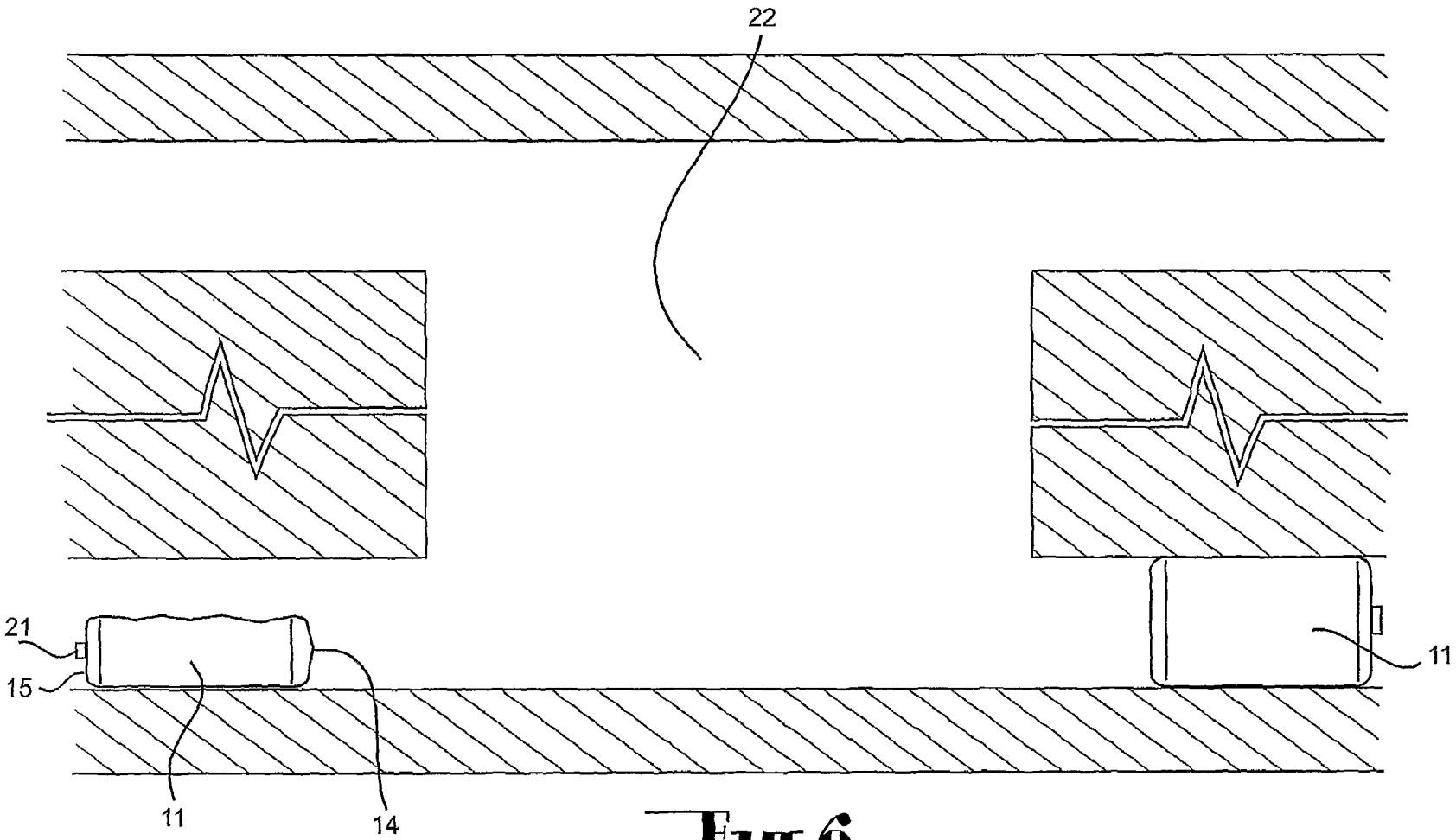
FIG. 6 is a diagrammatic elevation view of a mine portion representing two tunnel barriers of FIG. 4 in position in a mine, the left barrier being partially inflated and the right barrier being fully inflated.
Figure 7:
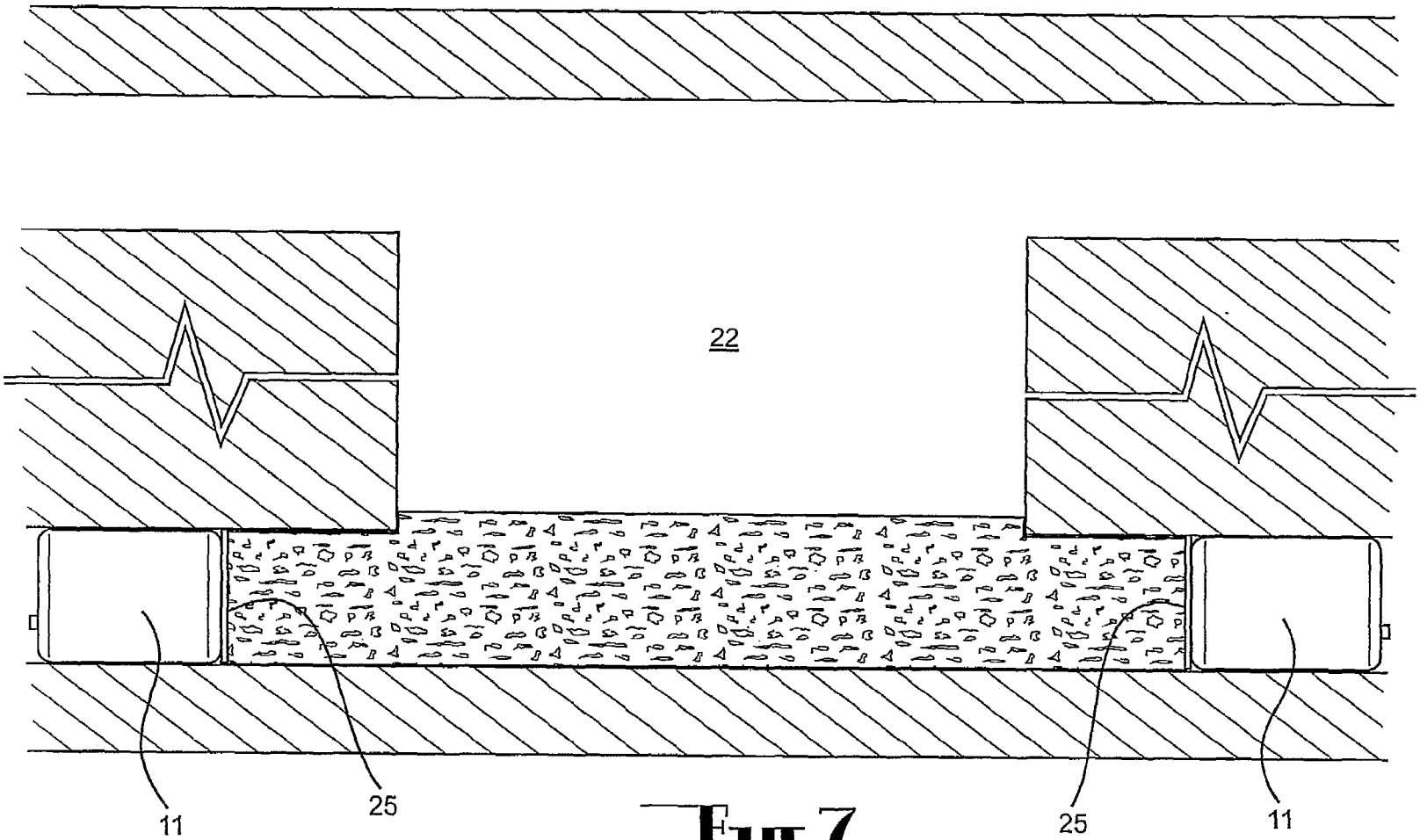
FIG. 7 is a diagrammatic elevation view of a mine portion of FIG. 6 after fill material has been deposited in the void.

The tunnel barrier 11 of the second embodiment, has a rear wall 15 and a front wall 14 and a side wall 16 which includes the roof and the floor. An inflation port is provide in the rear wall, but not in the front wall. The tunnel barrier of the second embodiment 11 is particularly directed to being used as a barrier wall in a tunnel and is erected prior to the filling of a void 22 as described above. In such an application, the tunnel barrier is positioned to have the front wall approximately 5 meters from the commencement of the void 22, as depicted in FIGS. 3 and 4. This is standard practice with existing barrier walls for safety reasons.

Again, in use, the tunnel barrier requires inflation to only a very low pressure in the vicinity of 4 to 20 kpa (0.5 to 2.5 psi) the pressure may depend upon the fill material being used. For highly viscous materials such as paste fill, the pressure required is very low. Because of the properties of the paste fill, when the fill is inserted into the void, it flows only as an ooze and solidifies relatively quickly. The amount of fill input in the first filling stage is to a level only just above the level of the tunnel, the pressure to be resisted is small and thus low inflation and pressure is quite satisfactory for the application. For less viscous fill materials, a higher pressure may be needed. Nevertheless, the pressures are still sufficiently low as to have no significant safety issues associated with them.

In general it is a characteristic of the fill materials used that they will tend to adhere to the surface of most materials. Therefore, in use, the front wall of the tunnel barrier is usually covered with a layer to prevent such sticking. In certain applications, it may be practical to use a grease-like or wax-like layer for this purpose but usually the layer comprises a sacrificial layer of fabric, cloth or plastics sheet. When a layer of this type is used it will adhere to the surface of the fill material but will prevent the fill material from actually contacting the front wall 14 of the tunnel barrier 11. When the tunnel barrier is removed after use, the sacrificial layer will remain attached to the cured fill material. This is of no consequence as the sacrificial layer comprises an inexpensive material. In this way, the tunnel barrier of the embodiment is easily removed after use in a way that leaves it capable of re-use. This is in contrast to existing concrete barrier walls which cannot be reused.

Where certain types of fill are being used to fill the void, it may be necessary to also provide a barricade between the tunnel barrier and the fill material which provides physical protection to the front wall of the tunnel barrier. This may be necessary particularly when rock fill is used to prevent a rock ricocheting into the front wall in a way which will puncture it. A suitable barrier is a panel of steel, chipboard or plywood mounted across the tunnel. The panel 25 can be assembled from a plurality of sub-panels in a way which can be disassembled easily after use for re-use. The panel needs only to be held in place during erection of the inflatable tunnel barrier and to prevent the panel falling forward of the tunnel barrier prior to or during the initial stages of filling of the void. It is desirable that the panel can move rearwardly a small extent relative to the tunnel barrier to thereby be supported by the tunnel barrier during impact by a rock so that the shock loading can be transmitted to some degree into the inflated tunnel barrier.

Where such a panel 25 is used, it will be appreciated that it is appropriate to apply an appropriate non-stick layer to prevent the adherence of the fill material between the fill material and the panel 25.

The second embodiment is directed a particular use wherein the bowing out of the front wall has some significance. Because the rockfill face in the tunnel will take the profile of front wall 14 of the tunnel barrier where no barricade is provided, it is desirable to restrict the bowing of the front face to a reasonable degree. Therefore the tunnel barrier of the second embodiment further comprises a plurality of restraining straps 26 extending internally within the tunnel barrier. The restraining straps are formed from substantially inextensible material, typically webbing of the type used for motor vehicle seat belts or similar. The restraining straps are installed internally within the tunnel barrier and sewn to the front and rear wall during construction. When the tunnel barrier is inflated, the tension is applied to the restraining straps to restrict the extent to which the front and rear panels can bow out.

It should be appreciated that the scope of the present invention need not be limited to the particular scope of the embodiment described above. All such adaptations are intended to be included within the scope of the invention.

The invention claimed is:

1. A tunnel barrier adapted to seal a mine tunnel, the tunnel barrier comprising an inflatable bladder having a front wall, a rear wall and a side wall and being adapted to be inflated by a suitable gas, wherein the side wall is adapted to contact the tunnel walls, including the roof and floor to thereby seal the tunnel, the front and rear walls being interconnected by a restraining element that extends through the bladder to connect the front and the rear walls at respective positions located intermediate of their connection to the side wall to limit the relative movement of the front and rear walls away from each other.

2. A tunnel barrier as claimed at claim 1 wherein the restraining element comprises at least one flexible, substantially inextensible connection extending between the front wall and rear wall.

3. A tunnel barrier as claimed at claim 2 wherein the restraining element comprises at least one elongate cord-like element.

4. A tunnel barrier as claimed at claim 2 wherein the restraining element comprises a webbing material.

5. A tunnel barrier as claimed at claim 1 wherein the base of the tunnel barrier is substantially square.

6. A tunnel barrier as claimed at claim 5 wherein the tunnel barrier has a generally cubic shape when inflated.

7. A tunnel barrier as claimed at claim 1 wherein the cross-section of the tunnel barrier when inflated conforms to the cross-section of the tunnel to thereby seal the tunnel.

8. A tunnel barrier as claimed at claim 1 wherein the tunnel barrier is re-usable.

9. A tunnel barrier as claimed at claim 1 wherein the bladder is manufactured from fibre-reinforced polyvinyl chloride (PVC).

10. A tunnel barrier as claimed at claim 9 wherein the inflation port comprises a rimmed aperture in the wall of the bladder, the rimmed aperture being in use intended to be connected to a forced air supply.

11. A tunnel barrier as claimed claim 9 wherein in use the tunnel barrier is adapted to seal a tunnel during the partial filling of an adjacent void to prevent fill material from the void entering the tunnel beyond the barrier, whereby, the front wall defines a face of the void.

12. A tunnel barrier as claimed at claim 11 wherein the front wall is covered by a layer to prevent fill material from adhering to the front wall.

13. A tunnel barrier as claimed at claim 12 wherein the layer comprises a grease-like or wax-like material covering the front wall.

14. A tunnel barrier as claimed at claim 12 wherein the layer comprises a sacrificial lining to prevent cured fill material from adhering to the front wall.

15. A tunnel barrier as claimed at claim 14 wherein the sacrificial lining comprises a sheet of fabric or plastics material.

16. A tunnel barrier as claimed at claim 12 wherein the front wall is protected by a physical barrier capable of withstanding the impact of fill material.

17. A tunnel barrier as claimed at claim 1 wherein the bladder is manufactured from a polyvinyl chloride coated with acrylic lacquer or similar material.

18. A tunnel barrier as claimed at claim 1 wherein the bladder is manufactured from a woven polyester or similar material.

19. A tunnel barrier as claimed at claim 1 wherein the tunnel barrier is inflatable via an inflation port in the rear wall.

20. A tunnel barrier as claimed claim 1 wherein the tunnel barrier is inflatable via an inflation port in the front wall.

21. A tunnel barrier in accordance with claim wherein the restraining element comprises a plurality of parallel straps made of a flexible and substantially inextensible material, said straps extending in parallel with a longitudinal axis of the inflatable bladder, said straps having lengths selected to restrict the extent to which the front and rear walls bow out when the bladder is installed in a tunnel and pressurized.

22. A method of sealing a tunnel, the method comprising the steps of positioning an inflatable tunnel barrier in a desired location in the tunnel with tunnel walls including a roof and a floor therein said tunnel barrier having an inflatable bladder with a front wall, a rear wall and a side wall and being adapted to be inflated by a suitable gas, wherein the side wall is adapted to contact the tunnel walls, including the roof and floor to thereby seal the tunnel, the front and rear walls being interconnected by a restraining element that extends through the bladder to connect the front and the rear walls at respective positions located intermediate of their connection to the side wall to limit the relative movement of the front and rear walls away from each other, and inflating the tunnel barrier to cause the side walls of the barrier to contact and thereby seal the tunnel, whereby the front wall is caused to act as a barrier to said fill material during partial filling of the void.

23. A method of sealing a tunnel as claimed at claim 22 wherein a void in the tunnel is filled in a plurality of filling operations wherein in the first filling operation the fill material comprises a settable composition and the fill is added to the void to a first level and the fill material is allowed to cure before a subsequent fill operation is undertaken.

24. A method of sealing a tunnel as claimed at claim 23 wherein a non-stick layer is applied over the front wall prior to filling of the void to prevent fill material from adhering to the front wall.

25. A method of sealing a tunnel as claimed at claim 23 wherein a sacrificial lining is placed over the front of the front wall to prevent cured fill material from adhering to the front wall.

26. A method of sealing a tunnel as claimed at claim 23 wherein the method further comprises the step of installing a physical barrier in front of the front wall to protect the front wall from the impact by a fill material.

* * * * *